US012674299B2

(12) United States Patent
Vera Torres et al.

(10) Patent No.: US 12,674,299 B2
(45) Date of Patent: Jul. 7, 2026

(54) MODIFIED BUCKET

(71) Applicant: Minetec S.A., Santiago (CL)

(72) Inventors: Bernardo Luis Vera Torres, Santiago (CL); Fernando Esteban De La Fuente López, Santiago (CL); Antonio Flores, Santiago (CL)

(73) Assignee: Minetec S.A., Santiago (CL)

( * ) Notice: Subject to any disclaimer, the term of this patent is extended or adjusted under 35 U.S.C. 154(b) by 799 days.

(21) Appl. No.: 18/161,229

(22) Filed: Jan. 30, 2023

(65) Prior Publication Data

US 2023/0250610 A1 Aug. 10, 2023

(30) Foreign Application Priority Data

Feb. 7, 2022 (CL) ..... 202200313

(51) Int. Cl.
*E02F 3/60* (2006.01)
*E02F 9/28* (2006.01)

(52) U.S. Cl.
CPC ..... *E02F 3/60* (2013.01); *E02F 9/2808* (2013.01)

(58) Field of Classification Search
None
See application file for complete search history.

(56) References Cited

U.S. PATENT DOCUMENTS

2017/0073935 A1* 3/2017 Friend ..... E02F 9/265
2017/0306585 A1* 10/2017 Zamorano Jones .... E02F 9/006
2017/0350092 A1* 12/2017 Bozich ..... E02F 3/4075
2022/0412042 A1* 12/2022 Kunz ..... E02F 9/2883

FOREIGN PATENT DOCUMENTS

EP 2284361 A2 * 2/2011 ..... F01D 5/005

* cited by examiner

*Primary Examiner* — Christopher J Sebesta
*Assistant Examiner* — Alfred H Tsui
(74) *Attorney, Agent, or Firm* — Hoffman Warnick LLC

(57) ABSTRACT

Modified bucket that combines elements of buckets from different models of excavator shovels.

8 Claims, 10 Drawing Sheets

MODIFIED BUCKET

TECHNICAL FIELD

The utility model is developed in the field of components for excavator shovels and specifically refers to a modified bucket that combines bucket elements of a first cable shovel model and a second cable shovel model, which can be connected to the blade of said first model of cable blade.

DESCRIPTION OF THE PRIOR ART

In the state of the art there are, among others, two models of buckets for cable excavator shovels that represent the vast majority of existing excavator shovels.

In mining, in order to reduce the maintenance times of cable shovel buckets for both models, keep a complete line of spare parts for buckets in stock, such as pins, ground engagement tools (GET), Bushings and some accessories is quite complicated, especially in cases where there is only one supplier of said spare part (local OEM distributor).

Currently, shovels of similar capacity can be used in a mining operation, but they are provided by different manufacturers, which must maintain a minimum stock of spare parts separately, and said spare parts for each product line are incompatible with each other, which implies greater costs, storage times, transport and sometimes generate stock breaks without replacement alternatives.

In the state of the art, buckets for excavator shovels have been disclosed that seek to provide designs that can include interchangeable parts with different models of shovels.

In this regard, document CL1261-2017 can be cited, which describes a modified bucket for a cable excavator shovel that allows it to be connected indistinctly to two different types of cable excavator shovels, where a modified design of the connection elements of said connection elements is disclosed. bucket, being compatible with the two connection models of said two types of excavator shovels. This document addresses the problem of the interchangeability of responses from different types of buckets, however, it presents the functional disadvantage that the connection elements, being adaptable, increase the weight of the bucket and the change or adaptation of the connection elements to a model in particular it is not automatic and requires the replacement of parts, which delays the operation.

The modified bucket of this invention generates a new bucket design, compatible with the spare parts that have been shown to have better performance in each of the two models of buckets corresponding to the two models of blades for the same capacity, which helps to reduce the quantity of necessary spare parts in stock and at the same time generate a much more reliable and economical supply chain.

Utility Model Summary

The utility model discloses a new type of modified bucket that combines bucket elements of a first model of cable shovel and a second model of cable shovel, being able to be connected to the shovel of said first model of cable shovel, which has with the objective of reducing the number of spare parts in stock and generating a more reliable and economical supply chain in mining operations that use buckets of two types or models of cable excavator shovels.

The modified bucket comprises connection elements of the bucket of said first model of the shovel, for its connection to it by means of the handle of the shovel, wherein said connection elements include the bushings and pins that connect the handle with the bucket of the first model. blade, the connection of the regulating elements (pitch brace) with their bushings and pins, and the connection elements of the inclination cables with their pins. Tilt cables, push or lift, are attached to the bucket to control its tilt during backhoe operation.

The door with its bushings and pins, the bottom, the lip, the GET tools, the snubber eye with its insert and the door stops (snubber) of the modified bucket will correspond to the bucket of the second model of shovel.

The upper part of the modified bucket comprises a mechanical connection for a door stop ("Snubber").

BRIEF DESCRIPTION OF THE FIGURES

The accompanying drawings are included to provide a further understanding of the utility model and constitute part of this description and further illustrate a preferred embodiment of the utility model, where it is seen that.

DETAILED DESCRIPTION OF THE UTILITY MODEL

Figure 1A:
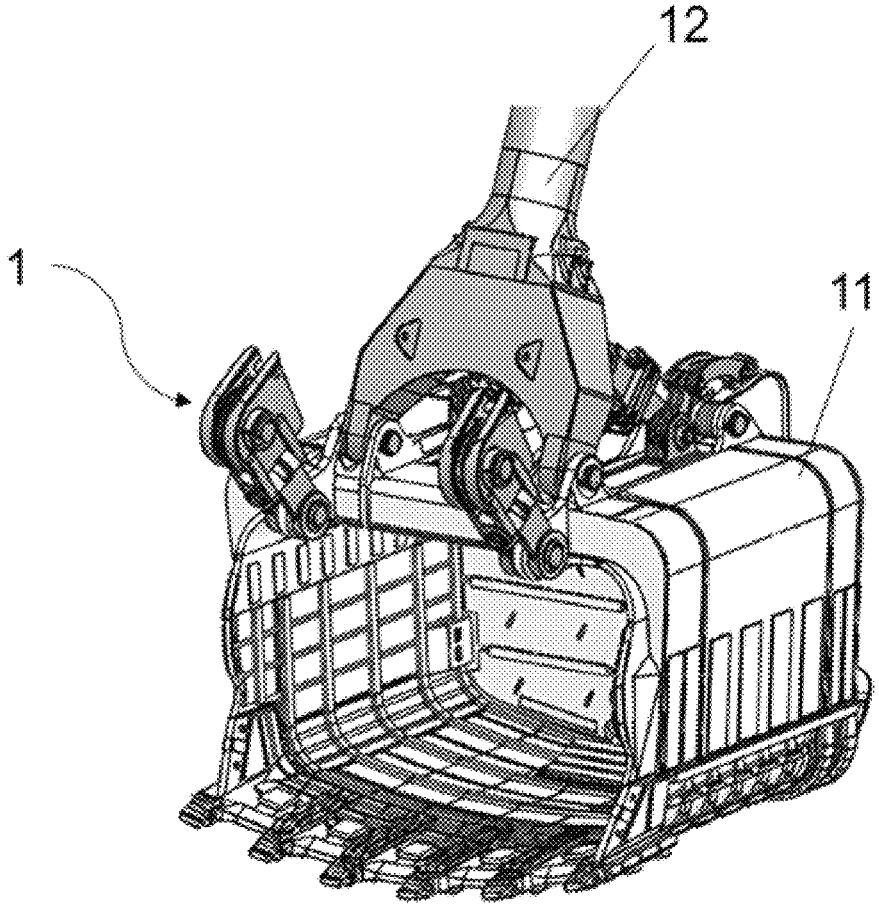
Figure 1A PRIOR ART
FIG. 1A shows a front perspective view of a bucket for a first model of cable excavator shovel with its spare parts and its connection with the handle of said first shovel model.

The utility model refers to a modified bucket (3) that combines spare parts and/or parts of a bucket (11) of a first model of cable excavator shovel (1) and a bucket (21) of a second shovel model. cable excavator (2) to be connected to said first model of cable excavator shovel (1).

The purpose of the utility model is to reduce the number of spare parts in stock and generate a more reliable and economical supply chain in mining operations that use buckets of two types or models of cable excavator shovels.

This utility model allows, in a mining operation, in which two models of cable excavator shovels (1, 2) are used, a modified bucket (3) that uses spare parts and/or parts of the buckets (11) is provided, 21) of each blade model (1, 2) achieving a partial unification of said spare parts, producing operational advantages and stock of spare parts.

Figure 1B:
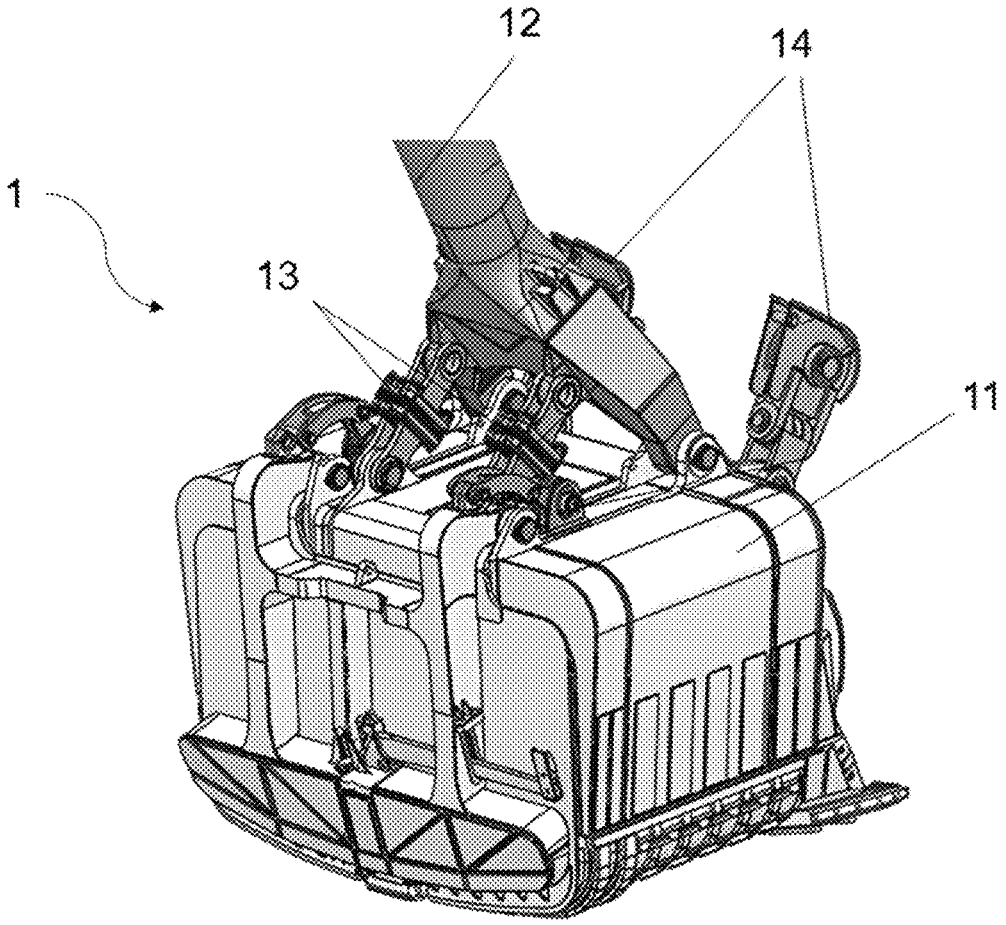
Figure 1B PRIOR ART
FIG. 1B shows a rear perspective view of a bucket for a first model of cable excavator shovel with its spare parts and its connection with the handle of said first shovel model.

In the first model of cable excavator shovel (1), according to FIGS. 1A and 1B, the bucket (11) is attached to a handle (12) of the shovel by means of connection components that comprise bushings and connection pins (15) of the handle (12); regulating elements (pitch brace) (13) with their bushings and connection pins (16); and connecting elements of the tilt cables that are joined with their bushings and connecting pins (17) to connect the shovel with said bucket tilt cables (11). Depending on the excavator shovel, the connection elements of the inclination cables can be a padlock system (padlock) (14), a handle system (bail) or any element that allows the inclination cables of the shovel to be connected to the bucket. (eleven).

Figure 2A:
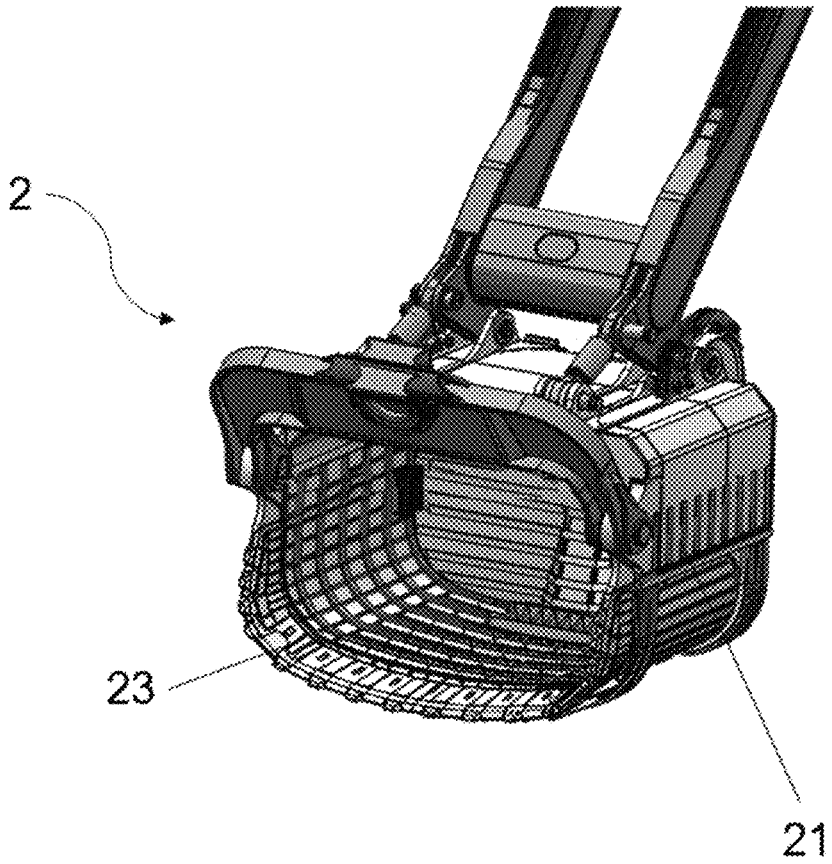
Figure 2A PRIOR ART
FIG. 2A shows a front perspective view of a bucket for a second cable excavator shovel model, its spare parts and its connection with the handle of said second shovel model.
Figure 2B:
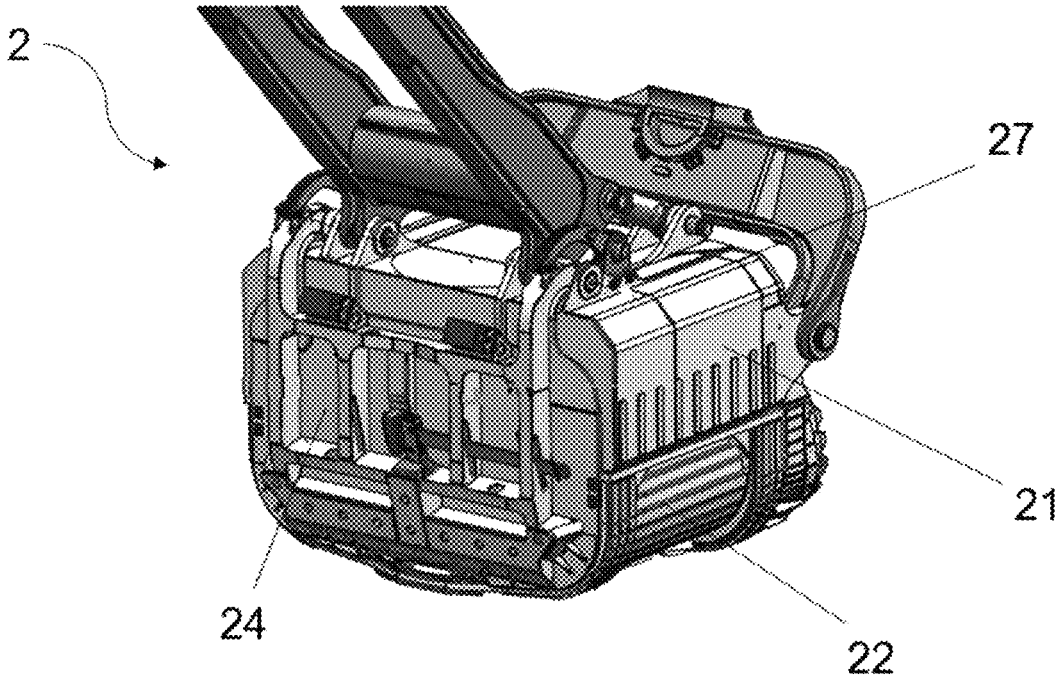
Figure 2B PRIOR ART
FIG. 2B shows a rear perspective view of a bucket for a second model of cable excavator shovel with its spare parts and its connection with the handle of said second shovel model.
Figure 4:
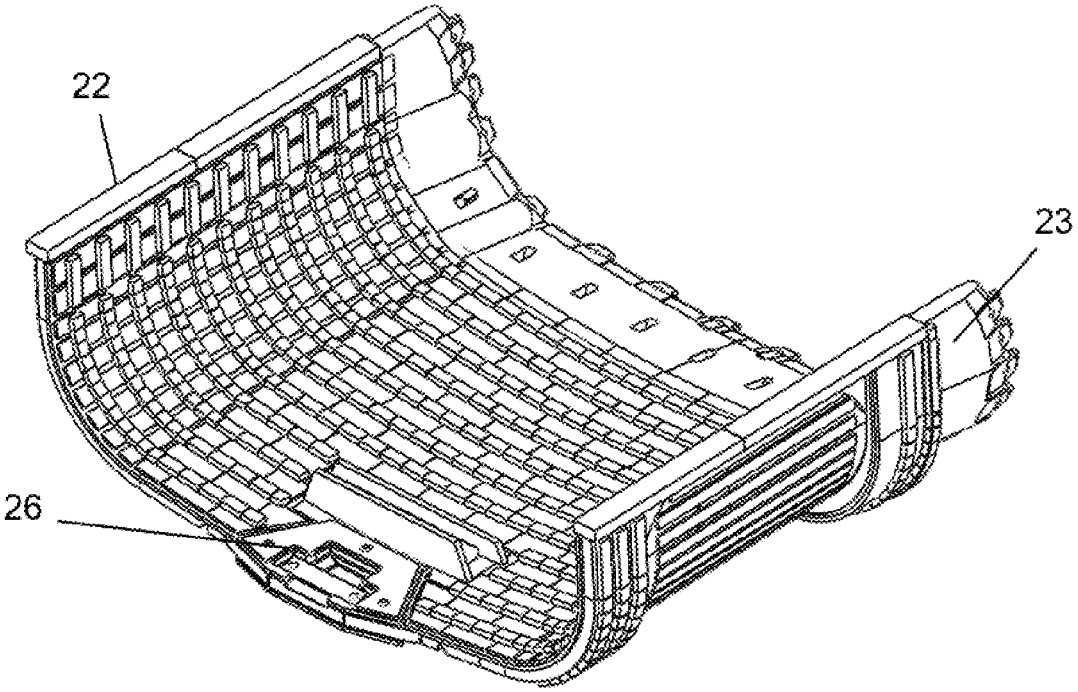
FIG. 4 shows the lower part of the modified bucket with its parts.
Figure 5:
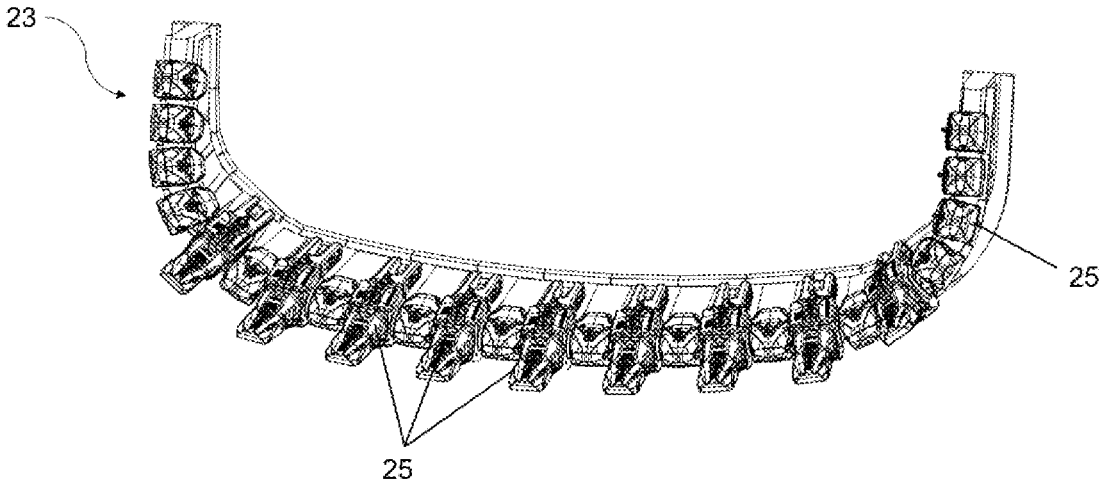
FIG. 5 shows the lip used on the modified bucket.

In the second model of cable excavator shovel (2), according to FIGS. 2A and 2B, the bucket (21) comprises a lower part (22) with a lip (23); an upper part (27) attached to the lower part (22), forming the volume of the bucket (21) and a door (24) at the back of the bucket (21) attached to the upper part (27) by means of bushings and pins (29). The lip (23) includes a plurality of noses on its outer edge that allow a plurality of ground tools (GET) (25) to be installed, as shown in FIG. 5. The lower part (22) includes a latch eye insert (26) that is connected in a corresponding way with the door (24) for its closure, as shown in FIG. 4. In the upper part (27) of the bucket (21) a door brake (snubber) (28) is included. fixed on the outer surface of said upper part (27) to cushion the closing of the door (24). The door brake (28) can be any type of brake, be it hydraulic, mechanical or of another type that makes it possible to cushion the closing of the door (24).

Figure 3:
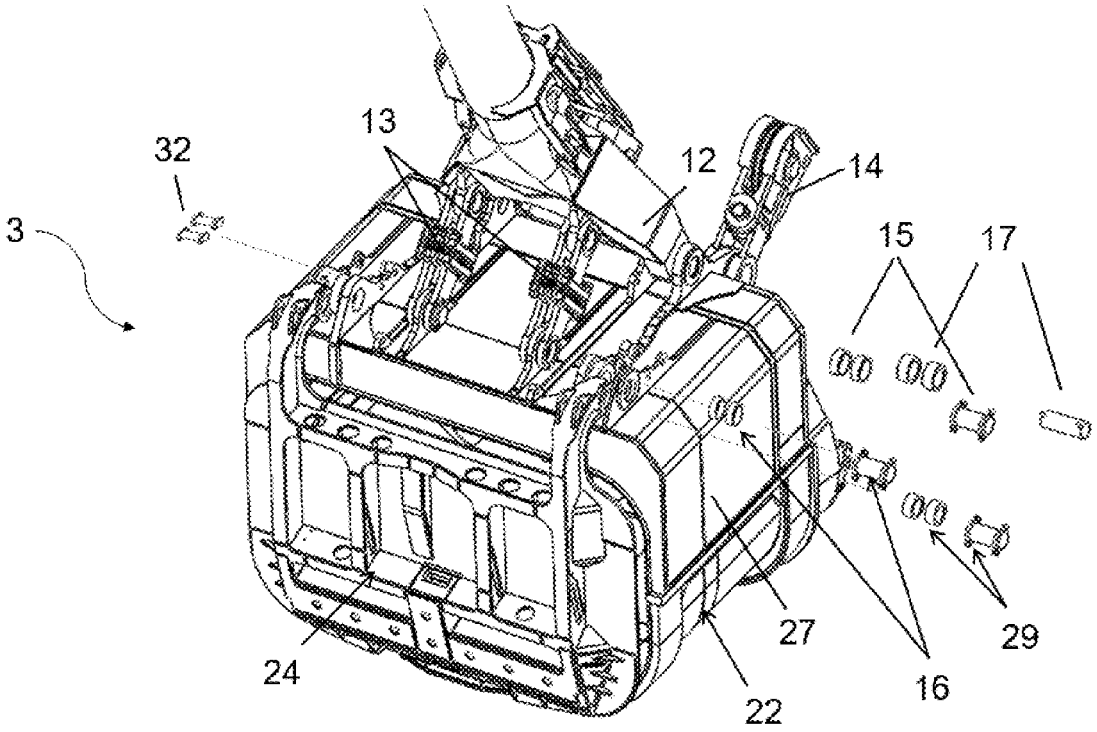
FIG. 3 shows a posterior isometric of the modified bucket with its related parts, according to a modality of the present utility model.

The modified bucket (3) is made based on the spare parts and/or parts of the bucket (21) of the second cable excavator shovel model (2), which is modified to join the connection of the handle (12) of the first cable excavator shovel model (1), as shown in FIG. 3.

In a preferred modality, the modified bucket (3) comprises a set of spare parts and/or parts of the bucket (21) of the second model of cable excavator shovel (2) that includes the lower part (22), the upper part (27) and the door (24) with its bushings and pins (29) attached to the rear part of said upper part (27). The lower part (22) has attached the lip (23) of the second model of cable excavator shovel (2), which includes a plurality of noses on its outer edge that allow a plurality of soil tools (GET) (25) to be installed, corresponding to said second model of cable excavator shovel (2). In another modality, the lower part of the modified bucket (3) can correspond to the lower part of the bucket (11) of the first model of cable excavator shovel (1).

Alternatively, the lower part (22) can have a lip welded corresponding to the bucket (11) of the first model of cable excavator shovel (1), where a plurality of soil engagement tools (GET) must be used, in which lip noses, corresponding to said first model of cable excavator shovel (1). Depending on the particular needs of the mining operation where the cable excavator shovels are used, other types of lips other than those indicated may be used in order to install other ground hook tools (GET) that are convenient for the Stock management of spare parts.

Figure 6:
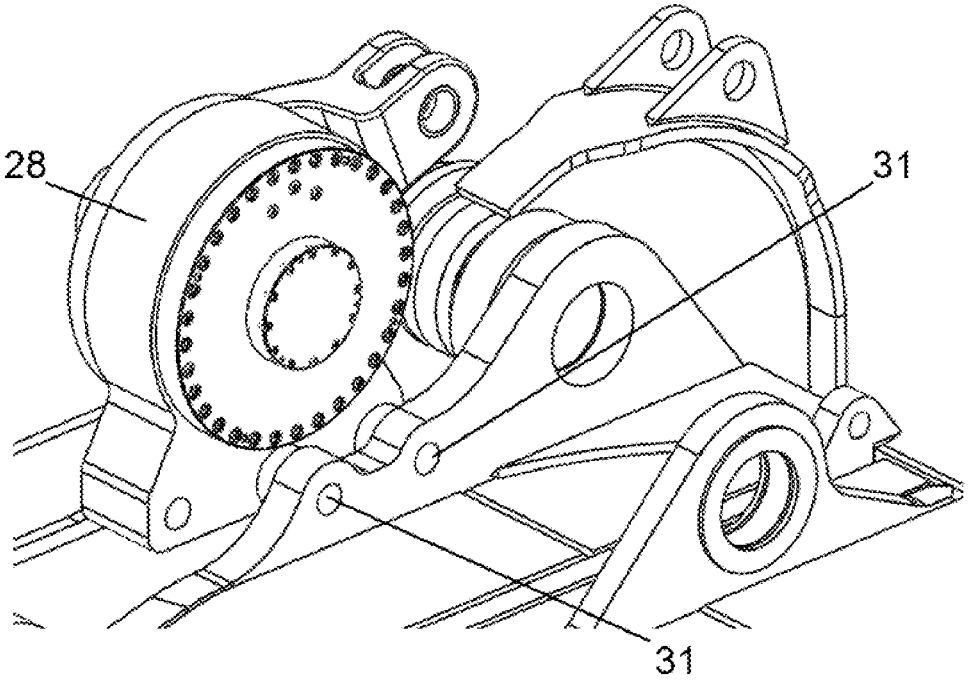
FIG. 6 shows a door stopper (snubber) and its mounting holes in the modified bucket.

The set of spare parts and/or parts of the bucket (21) of the second model of cable excavator shovel (2) also includes the door brake (28) located in the upper part (27) of the bucket (21), where said door stop (28) can be fixed to the bucket (21) by means of a welded connection or by means of a mechanical connection. The modified bucket (3) includes perforations (31) on the outer surface of the upper part (27) for the installation of said hydraulic door brake (28), as shown in FIG. 6, modifying the original union of the brake. door (28) with the upper part (27), which is welded, by a mechanical union using bushings and pins (32).

Figure 7A:
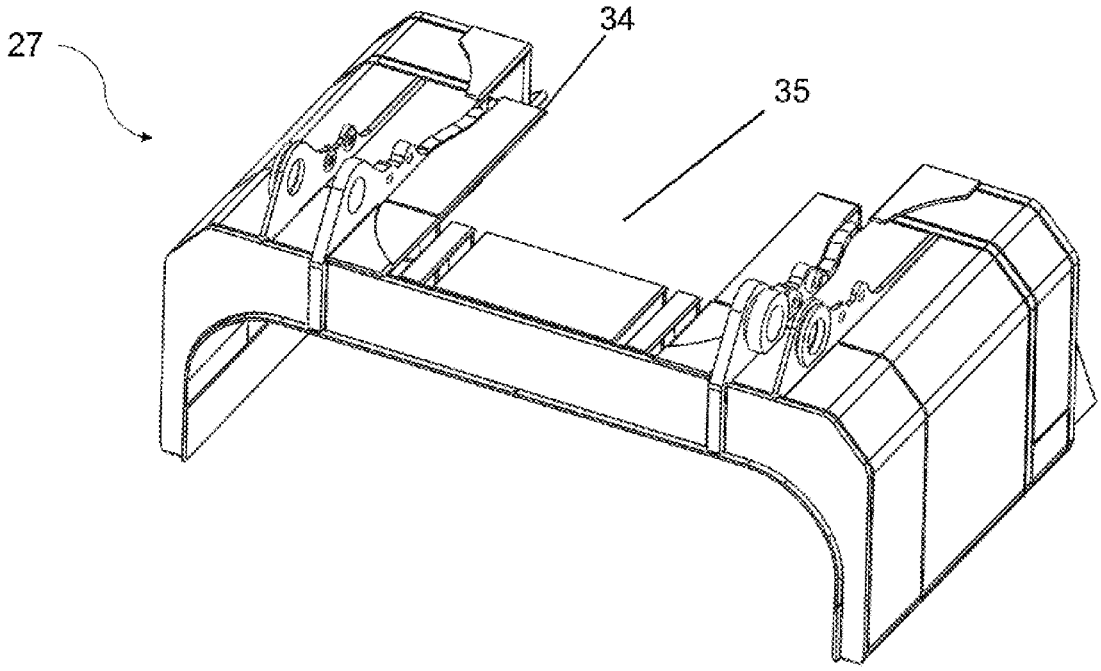
FIG. 7A shows the modified upper part of a bucket of a second model of cable excavator shovel with part of its upper surface cut away to receive an adaptation kit.
Figure 7B:
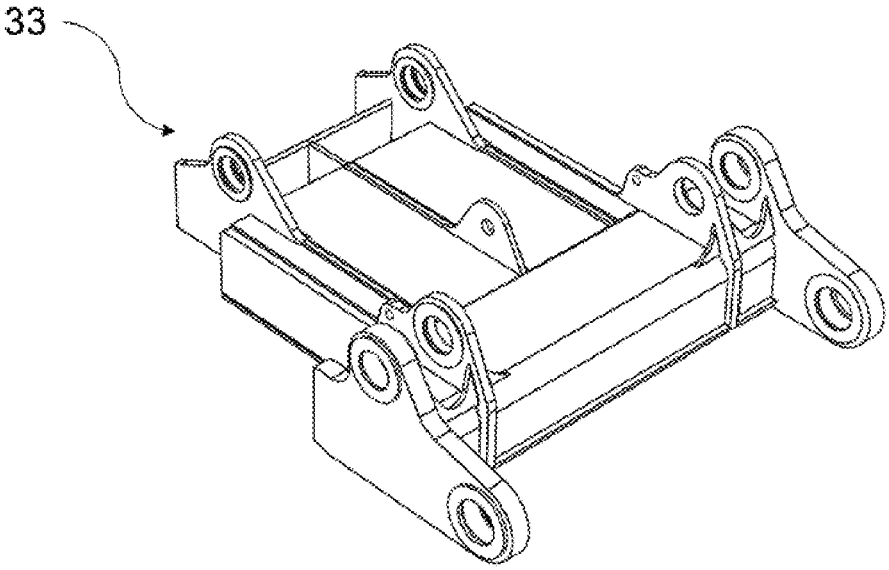
FIG. 7B shows the adaptation kit used in the modified bucket for its connection with the handle of a first model of cable excavator shovel.
Figure 7C:
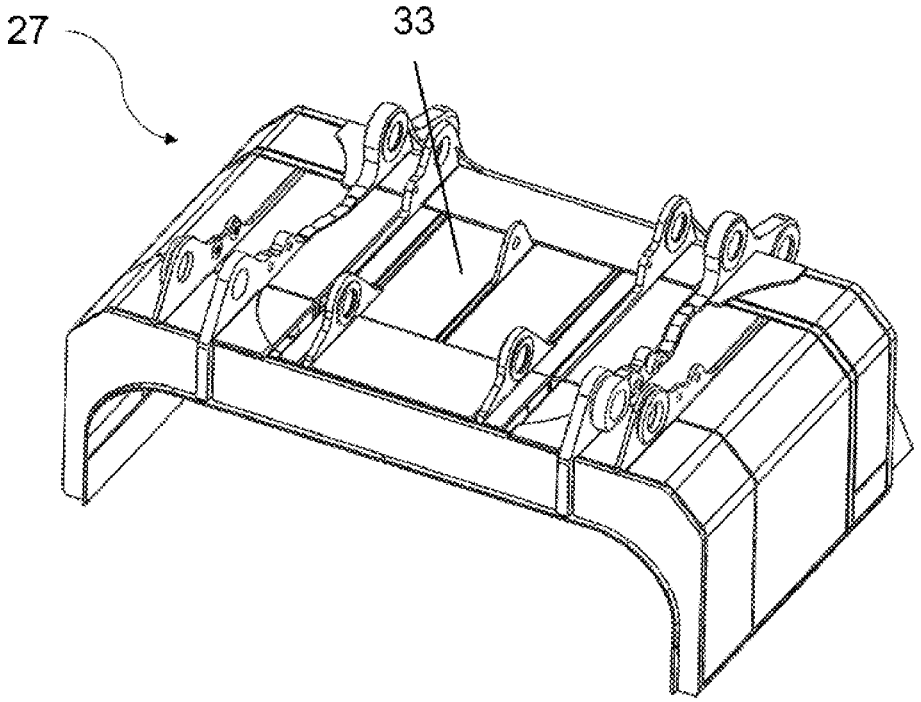
FIG. 7C shows the upper part of a bucket of a second model of cable excavator shovel with the welded adaptation kit for its connection with the handle of the first shovel model.
Figure 8:
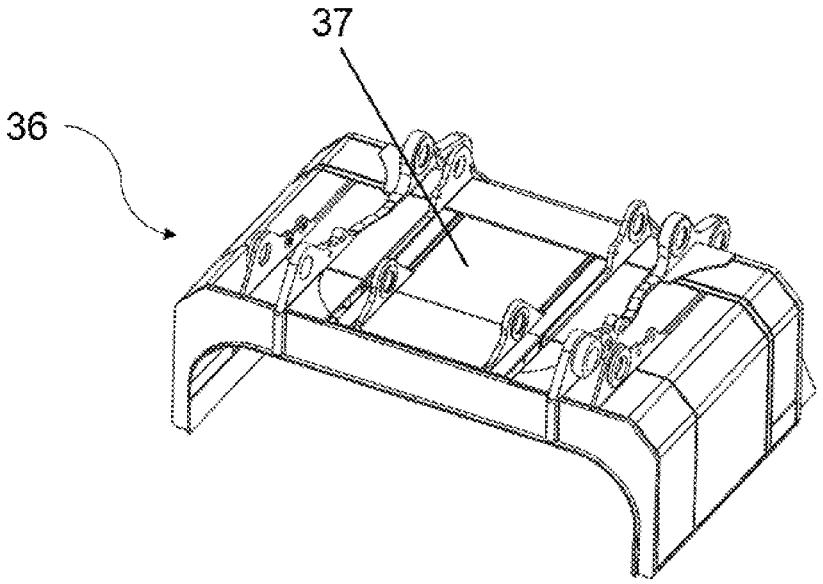
FIG. 8 shows the upper part of a new bucket made with the connection for the first model of the blade.
Figure 9:
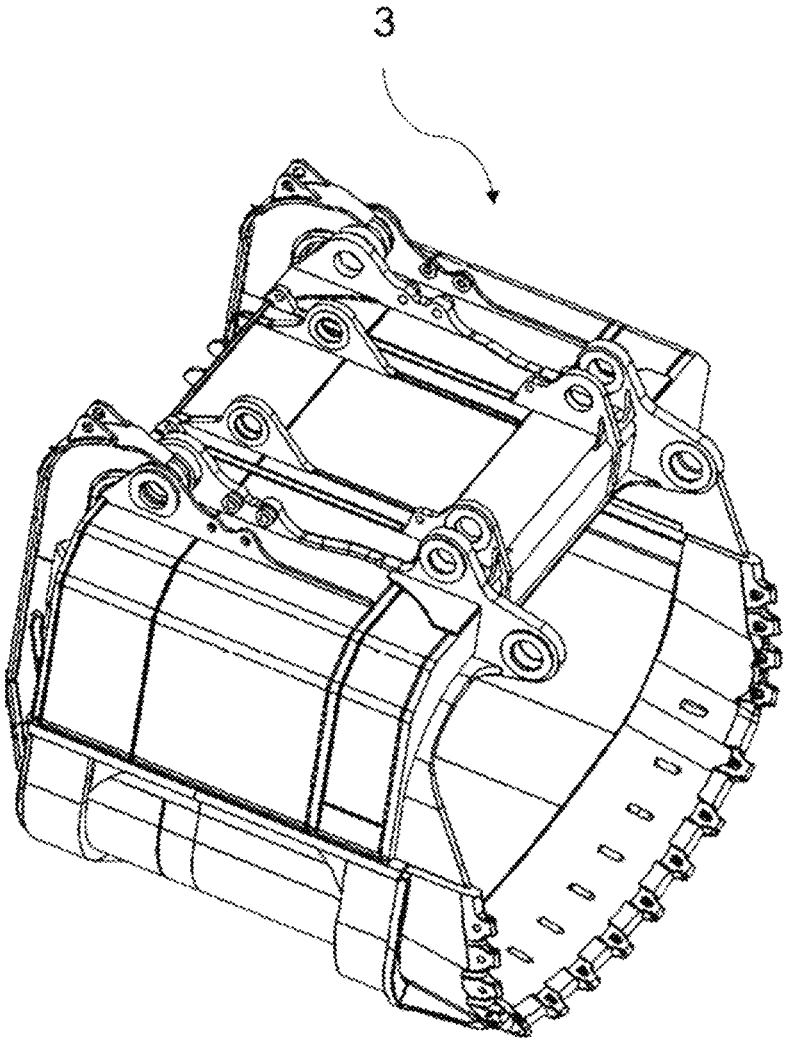
FIG. 9 shows a perspective view of the bucket modified according to the present utility model.

To connect the modified bucket (3) to the first model of cable excavator shovel (1), the upper part (27) includes the connection components between the bucket (11) and the handle (12) of said first model of excavator shovel cable (1), comprising the modified bucket (3), the bushings and connection pins (15) of the handle (12); regulating elements (pitch brace) (13) with their bushings and connection pins (16) that regulate the connection with the handle (12); and connection elements of the inclination cables that are connected with their bushings and connection pins (17) to generate the inclination movement of the bucket (3) by means of the inclination cables that make up the shovel. In addition, to achieve the connection between the modified bucket (3) and the handle (12) of the first model of cable excavator shovel (1), the upper part (27) is modified, as shown in FIGS. 7A, 7B and 7C, by means of a cut that allows a portion of said upper part (27) to be removed, leaving a space (35), due to the cut, with a contour (34) that allows said portion to be replaced by an adaptation kit (33) that is welded in the contour (34) of the previous cut, where said adaptation kit (33) includes connection means in which the connection components are connected to join the modified bucket (3) to the handle (12) of the first shovel model cable excavator (1). In one embodiment, the contour (34) of the cut and the outer edge of the adaptation kit have a stepped shape, as seen in FIGS. 7A and 7B.

Alternatively, the modified bucket (3) can include a new upper part (36), manufactured in one piece, comprising the connection means for connecting the handle (12) of the first model of cable excavator shovel (1) integrated into the upper surface (37) of said upper part (36) so that it is not necessary to make a cut in said piece to replace a portion with the adaptation kit (33).

In an alternative configuration, it is possible to interchange the components of the first model of cable excavator shovel (1) and the second model of cable excavator shovel (2), so that the elements of the modified bucket (3) corresponding to the first model of cable excavator shovel (1) can be replaced by the equivalent elements of the second model of cable excavator shovel (2) and the elements of the modified bucket (3) that correspond to the second model of cable excavator shovel (2) can be replaced by the equivalent elements of the first model of cable excavator shovel (1).

The invention claimed is:

1. A modified bucket (3) to connect to a handle (12) of a first model of cable excavator shovel (1) with a bucket (11), said modified bucket (3) having a structure based on a bucket (21) of a second model of a cable excavator shovel (2), wherein the first model of cable excavator shovel (1) and the second model of cable excavator shovel (2) have different means of connection to the respective bucket (11, 21), the modified bucket (3) comprising:

a set of pieces of the bucket (21) comprising a lower part (22) with a joined lip; an upper part (27) attached to the lower part (22), wherein said lower part (22) and said upper part (27) define the volume of the modified bucket (3); a door (24) attached to the rear of the upper part (27) by bushings and pins (29), and a snubber (28) on the upper part (27) to cushion the closing of the door (24);

wherein the upper part (27) comprises an adaptation kit (33), which is welded on a contour (34) formed by a cut at the upper part (27), wherein the adaptation kit (33) comprises connection means configured to join the modified bucket (3) to the handle (12) of the first model of cable excavator shovel (1), wherein connection components of the first model of cable excavator shovel (1) are connected to said connection means to connect the modified bucket (3) to the handle (12) of said first model of cable excavator shovel (1), said connection components comprising bushings and connection pins (15) of the handle (12); a pitch brace (13) comprising bushings and connection pins (16) that regulate the connection with the handle (12); and inclination cable connection elements comprising connected bushings and connection pins (17) to generate the inclination movement of the modified bucket (3) by means of cables.

2. The modified bucket (3) according to claim 1, wherein the snubber (28) is fixed to the upper part (27) by means of a welded joint.

3. The modified bucket (3) according to claim 1, wherein the snubber (28) is fixed to the upper part (27) by means of a mechanical connection.

4. The modified bucket (3) according to claim 3, wherein the upper part (27) includes perforations (31) on its outer surface to mechanically join the snubber (28) by means of bushings and pins (32) to the upper part (27).

5. The modified bucket (3) according to claim 1, wherein the snubber (28) is of a hydraulic, mechanical or other type that allows damping the closing of the door (24).

6. The modified bucket (3) according to claim 1, wherein the lower part (22) includes a latch eye insert (26) that connects correspondingly with the door (24) for its closure.

7. The modified bucket (3) according to claim 1, wherein the inclination cable connection elements correspond to a padlock system (14) comprising at least one padlock.

8. The modified bucket (3) according to claim 1, wherein the inclination cable connection elements correspond to a bail system.

* * * * *